US005153611A

United States Patent [19]

Kokado et al.

[11] Patent Number: 5,153,611

[45] Date of Patent: Oct. 6, 1992

[54] IMAGE FORMING APPARATUS

[75] Inventors: Hiroshi Kokado, Tokyo; Osamu Takemura, Nishinomiya, both of Japan

[73] Assignee: Mita Industrial Co., Ltd., Osaka, Japan

[21] Appl. No.: 555,004

[22] Filed: Jul. 20, 1990

[30] Foreign Application Priority Data

Jul. 25, 1989 [JP] Japan ..... 1-192215
Dec. 29, 1989 [JP] Japan ..... 1-341108

[51] Int. Cl.[5] ..... B41J 2/415; G03G 17/00

[52] U.S. Cl. ..... 346/140 R; 346/159; 355/261

[58] Field of Search ..... 346/140 R, 159, 158, 346/157, 155, 153.1; 355/261, 262, 263, 245, 246; 118/653; 101/DIG. 34

[56] References Cited

U.S. PATENT DOCUMENTS

| | | | |
|---|---|---|---|
| 3,266,046 | 8/1966 | Boyd | 346/159 |
| 3,285,167 | 11/1966 | Childress et al. | 101/114 |
| 3,689,935 | 9/1972 | Pressman et al. | 346/159 |
| 4,095,233 | 6/1978 | Goffe | 346/75 |
| 4,478,510 | 10/1984 | Fujii et al. | 346/159 |
| 4,491,855 | 1/1985 | Fujii et al. | 346/159 |
| 4,568,955 | 2/1986 | Hosoya et al. | 346/159 |
| 4,717,926 | 1/1988 | Hotomi | 346/140 R |
| 4,943,818 | 7/1990 | Hotomi | 346/140 R |

FOREIGN PATENT DOCUMENTS

| | | | |
|---|---|---|---|
| 57-19763 | 2/1982 | Japan . | |
| 59-54574 | 3/1984 | Japan . | |
| 62-176873 | 8/1987 | Japan . | |
| 0144362 | 6/1988 | Japan | 355/261 |
| 0134378 | 5/1989 | Japan | 355/261 |
| 2108432A | 5/1983 | United Kingdom . | |

*Primary Examiner*—Benjamin R. Fuller
*Assistant Examiner*—Alrick Bobb
*Attorney, Agent, or Firm*—Armstrong & Kubovcik

[57] ABSTRACT

Disclosed is an image forming apparatus, in which toner electrically charged in a prescribed polarity is fed from a toner feed device into a toner passage of a toner control device. A predetermined voltage is applied to an electrode of the toner control device in accordance with image signals given by an image information generating device, thereby forming an electric field for directing the toner through the toner passage from the toner-feed side to the toner ejection side of the toner control device. After passing through the toner passage, the toner falls down onto the recording paper placed on a base electrode, thereby forming a desired toner image thereon. Ultrasonic vibration with a variable frequency is applied to the toner control device to allow the toner to uniformly fall down therefrom. A prescribed voltage is applied to the base electrode to form an electric field for accelerating the falling of the toner from the toner control device toward the recording sheet.

14 Claims, 5 Drawing Sheets

Fig.1
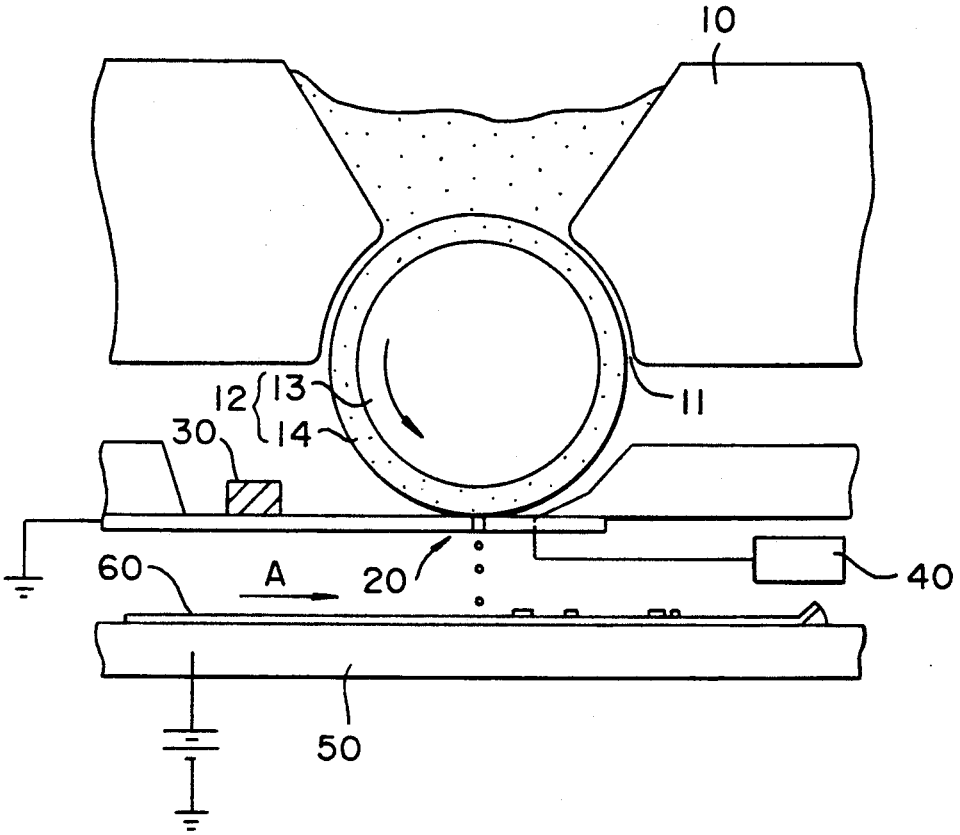
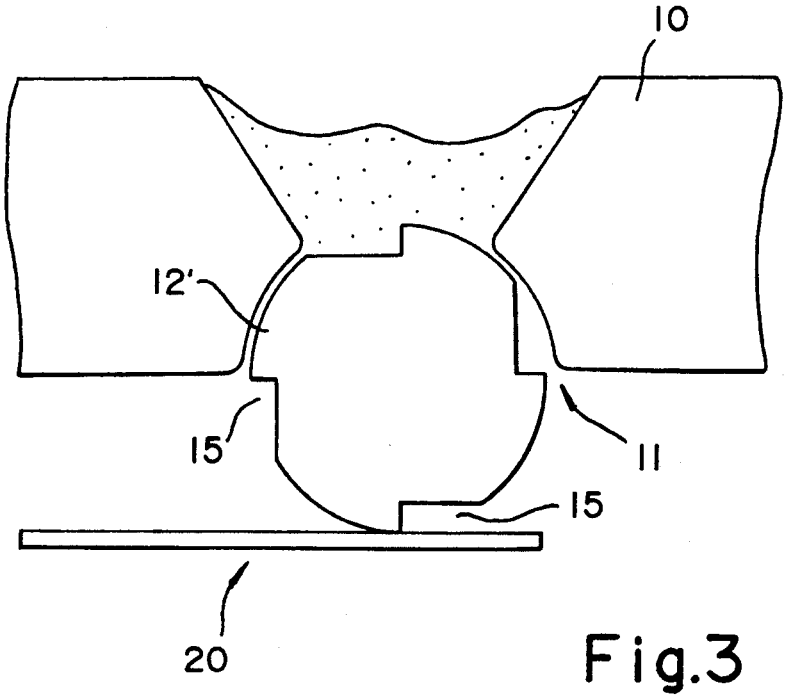
Fig.3

Fig.2
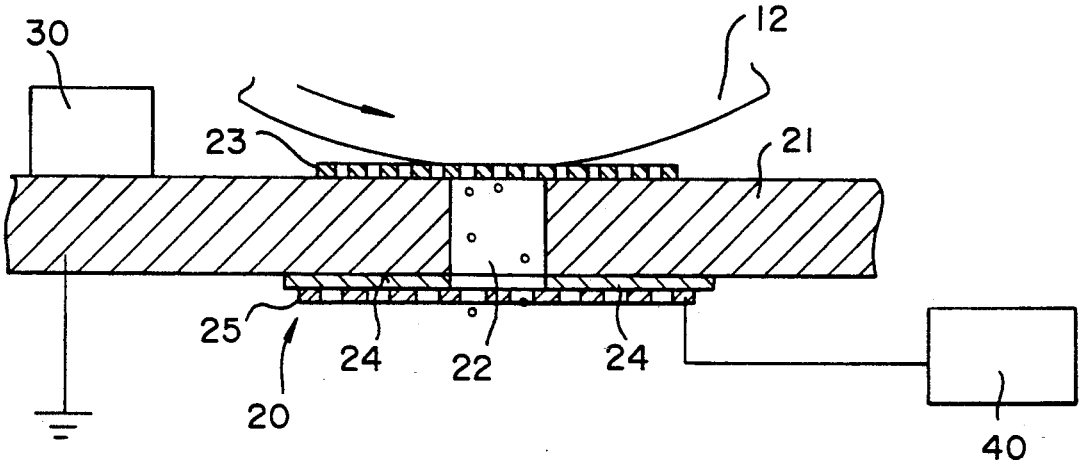
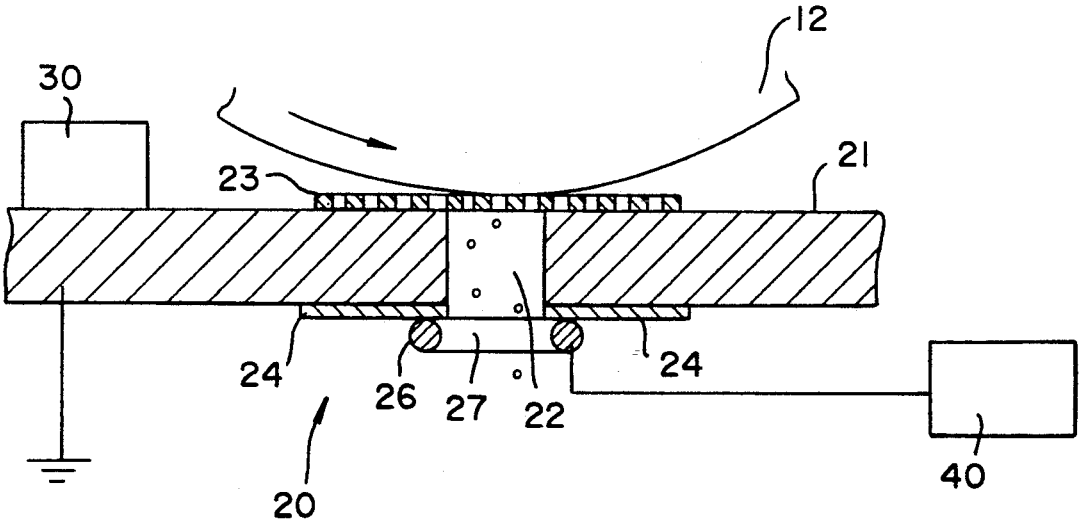
Fig.4

Fig.5
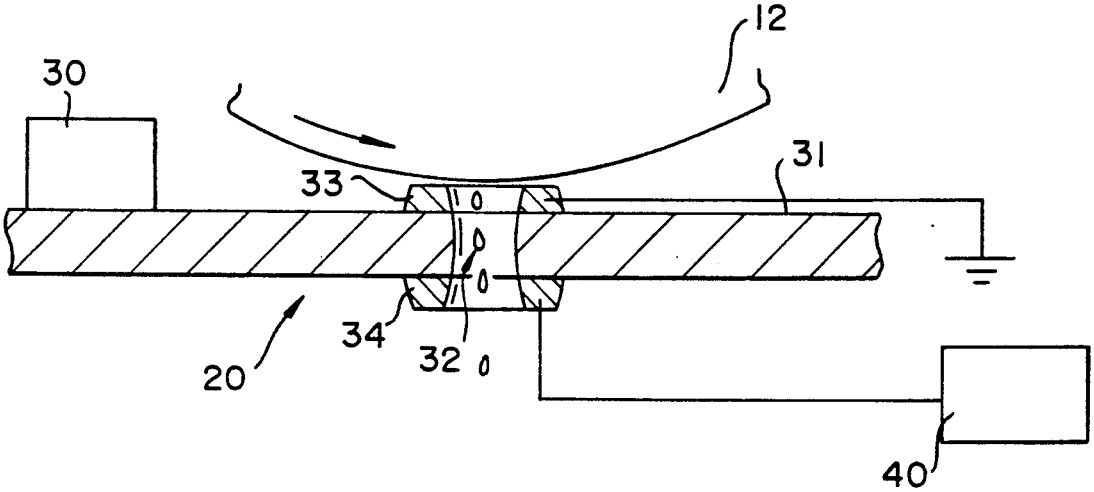
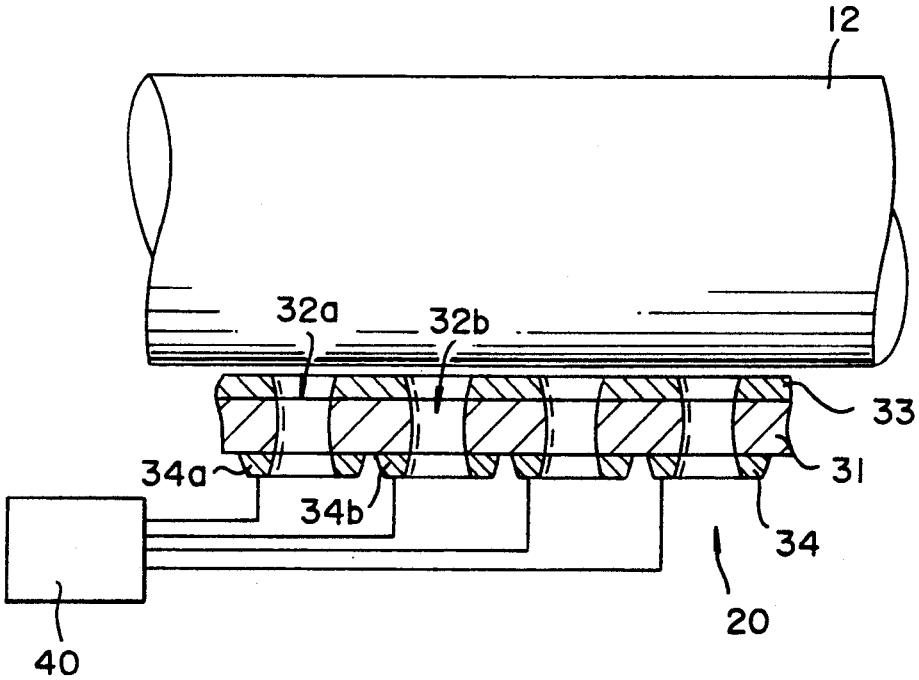
Fig.6

IMAGE FORMING APPARATUS

BACKGROUND OF THE INVENTION

1. Field of the Invention

The present invention relates to an image forming apparatus using powdered toner.

2. Description of the Prior Art

It is known that an image forming method using an ink-jet printer is employed in word processors, facsimile machines, computers, and the like.

The ink-jet printer is a typical example of a nonimpact printer. In the ink-jet printer, pressure is applied to a prescribed liquid ink while a piezoelectric element or the like applies ultrasonic vibration thereto, so that the ink is discharged into a prescribed electric field from an ink nozzle, the ink droplets being controlled by the electric field and made to adhere to a recording sheet to form an image thereon. Such an ink-jet printing method has the advantage of being able to form a clear image without generating noise during the formation of the image. On the other hand, this method is disadvantageous in that it requires the use of a special kind of recording sheet with its surface appropriately treated, so as to control the speed at which the ink filters into the recording paper. Also, the nozzle through which the ink is discharged tends to become clogged with foreign substances or the like included in the ink.

To overcome the above difficulties with the ink-jet printer, Japanese Laid-Open Patent Publication No. 62-176873 has proposed an image forming method using powdered toner as an image recording medium. This image forming method uses a mesh member to which ultrasonic vibration is applied, and a means for generating electrostatic attraction in accordance with image signals, the mesh member and the electrostatic attraction generating means facing each other. In this method, an insulating recording sheet is placed between the mesh member and the electrostatic attraction generating means, and powdered toner passed through the mesh member is selectively attracted to the recording sheet by means of the magnetic or electrostatic attraction generated according to the image signals, thereby forming a prescribed image on the recording sheet.

In an image forming apparatus utilizing this method, a sheet of plain paper can be used as the recording sheet. Furthermore, since the toner is passed through the mesh member to which ultrasonic vibration is applied, the mesh is prevented from becoming clogged with the toner.

On the other hand, the above image forming method involves the following problems because the insulating recording sheet is placed between the mesh member through which the toner is supplied and the electrostatic attraction generating means.

(1) When the toner is to be applied to the recording sheet by means of the electrostatic attraction, an electric field is formed between the mesh member and the electrostatic attraction generating means. As described above, the insulating recording sheet is placed between the mesh member and the electrostatic attraction generating means, i.e., in the electric field formed therebetween, so that sufficient electric field effect cannot be obtained.

(2) Since the recording sheet is disposed between the mesh member and the electrostatic attraction generating means, the resistivity of the recording sheet affects the density of the image to be formed thereon. The resistivity of the insulating recording sheet varies according to the kind of paper used, so that the density of the resultant image varies from one kind of sheet to another.

(3) Since the recording sheet is disposed between the mesh member and the electrostatic attraction generating means, the water content of the recording sheet also affects the density of the image to be formed thereon. Thus, the density of the resultant image is substantially susceptible to changes in humidity and other environmental conditions which have influence on the water content of the recording sheet. This means that the image density varies from one sheet to another not only when different kinds of recording sheets are used but also when the recording sheets of the same kind are used.

(4) In the case of using electrostatic attraction to apply the toner to the recording sheet, in order to improve the image quality, a large number of electrostatic attraction generating means are required to be disposed in parallel with the recording paper, so that each electrostatic attraction generating means controls the adhesion of the toner to the recording sheet. However, when a large number of electrostatic attraction generating means are disposed in parallel with the recording sheet, the electrostatic attraction generating means are very close to one another. Therefore, the adhesion of the toner cannot be precisely controlled by the respective electrostatic attraction generating means because they are influenced by the electric fields generated by the adjacent electrostatic attraction generating means. On the other hand, if the electrostatic attraction generating means are spaced far apart from the mesh member, it becomes even more difficult to control the adhesion of the toner.

(5) The amount of the toner supplied through the mesh member is not sufficient, which results in an insufficient density of the produced toner image. Also, toner particles, if collected together into lumps by the cohesion of the toner, cannot pass through the mesh member, and this results in an uneven density of the produced image.

SUMMARY OF THE INVENTION

The image forming apparatus of this invention, which overcomes the above-discussed and numerous other disadvantages and deficiencies of the prior art, comprises a toner feed device for feeding toner electrically charged in a prescribed polarity. A toner control device including a plate provided with a toner passage through which the toner fed from the toner feed device can pass, and includes an electrode for forming an electric field within the toner passage. The electric field directs the toner through the toner passage from the toner-feed side to the toner-ejection side of the plate. An ultrasonic vibration generating device applies ultrasonic vibration to toner control device. An image information generating device applies a predetermined voltage to the electrode of the toner control device in accordance with image information, thereby allowing the electrode to form the electric field. A base, electrode is located at the toner-ejection side of the toner control device and is appropriately spaced apart therefrom. To the base electrode, a predetermined voltage is applied to form an electric field for directing the toner from the toner passage toward the base electrode.

In a preferred embodiment, the ultrasonic vibration generating device produces ultrasonic waves, the frequency of which can be changed.

In a preferred embodiment, the electrode comprises a pair of mesh electrodes insulated from each other and mounted on either side of the plate so as to cover each opening of the toner passage.

In a preferred embodiment, the electrode comprises a mesh electrode mounted on the toner-feed side of the plate to cover one of the openings of the toner passage, and also comprises a ring electrode disposed on the toner-ejection side of the plate. The interior space of the ring electrode communicates with the other opening of the toner passage, and the ring electrode and the mesh electrode are insulated from each other.

In a preferred embodiment, the electrode comprises a pair of plate electrodes insulated from each other and mounted on either side of the plate. Each of the plate electrodes has a hole passing therethrough and communicates with each opening of the toner passage.

In a preferred embodiment, the toner feed device is a sponge roller having sponge on the circumference thereof.

Another image forming apparatus according to the present invention comprises a toner feed device for feeding toner electrically charged in a prescribed polarity. A toner control device includes a conductive plate provided with a toner passage through which the toner fed from the toner feed device can pass, and an electrode mounted on the conductive plate. The electrode and the conductive plate are capable of forming an electric field within the toner passage. The electric field directs the toner through the toner passage from the toner-feed side to the toner-ejection side of the conductive plate. An ultrasonic vibration generating device applies ultrasonic vibration to the toner control device. An image information generating device produces a potential difference between the conductive plate and the electrode of the toner control device in accordance with image information, thereby allowing the conductive plate and the electrode to form the electric field. A base electrode is located at the toner-ejection side of the toner control device and appropriately spaced apart therefrom, and to which a predetermined voltage is applied to form an electric field for directing said toner from said toner passage toward the base electrode.

In a preferred embodiment, the electrode is in the form of mesh and mounted on the toner-feed side of the conductive plate to cover one of the openings of the toner passage, the electrode being insulated from the conductive plate.

In a preferred embodiment, the ultrasonic vibration generating device produces ultrasonic waves, the frequency of which can be changed.

Still another image forming apparatus according to the present invention comprises a toner control device including a conductive plate provided with a toner passage through which toner can pass. The toner is electrically charged in a prescribed polarity. A toner feed device feeds the toner onto the conductive plate of the toner control device. The toner feed device includes a conductive portion. An ultrasonic vibration generating device applies ultrasonic vibration to the toner control device. An image information generating device produces a potential difference between the conductive portion of the toner feed device and the conductive plate in accordance with image information, thereby forming an electric field within the toner passage. The electric field directs the toner through the toner passage from the toner-feed side to the toner-ejection side of the conductive plate. A base electrode is located at the toner-ejection side of the toner control device and is appropriately spaced apart therefrom, and to which a predetermined voltage is applied so as to form an electric field for directing the toner from the toner passage toward the base electrode.

In a preferred embodiment, the toner feed device is a sponge roller comprising a conductive roller portion and an insulating sponge portion disposed on the circumferential surface thereof.

In a preferred embodiment, the ultrasonic vibration generating device produces ultrasonic waves, the frequency of which can be changed.

Thus, in the image forming apparatus of the invention, toner is passed through the toner passage of the toner control device to be applied to the recording sheet, thereby forming an image thereon. An electric field for allowing the toner to pass through the toner passage is formed apart from the recording sheet. Accordingly, changes in the kind or conditions of the recording sheet do not cause unevenness in the image density.

Since the toner control device is subjected to ultrasonic vibration generated by the ultrasonic vibration generating device, the toner can be effectively passed through the toner passage of the toner control device, resulting in a high-density image. The frequency of the ultrasonic wave to be generated by the ultrasonic vibration generating device can be changed, so that the toner falls more uniformly onto the recording sheet from the toner passage.

BRIEF DESCRIPTION OF THE DRAWINGS

This invention may be better understood and its numerous objects and advantages will become apparent to those skilled in the art by reference to the accompanying drawings as follows:

FIG. 1 is a schematic diagram showing a first example of the image forming apparatus according to the invention.

FIG. 2 is a fragmentary sectional view of the image forming apparatus of FIG. 1.

FIG. 3 is a schematic diagram showing a modified toner feed means.

FIG. 4 is a fragmentary sectional view showing a second example of the image forming apparatus according to the invention.

FIG. 5 is a fragmentary sectional view showing a third example of the image forming apparatus according to the invention.

FIG. 6 is a fragmentary sectional view showing a modified version of the image forming apparatus of FIG. 5.

DESCRIPTION OF THE PREFERRED EMBODIMENTS

Figure 7:
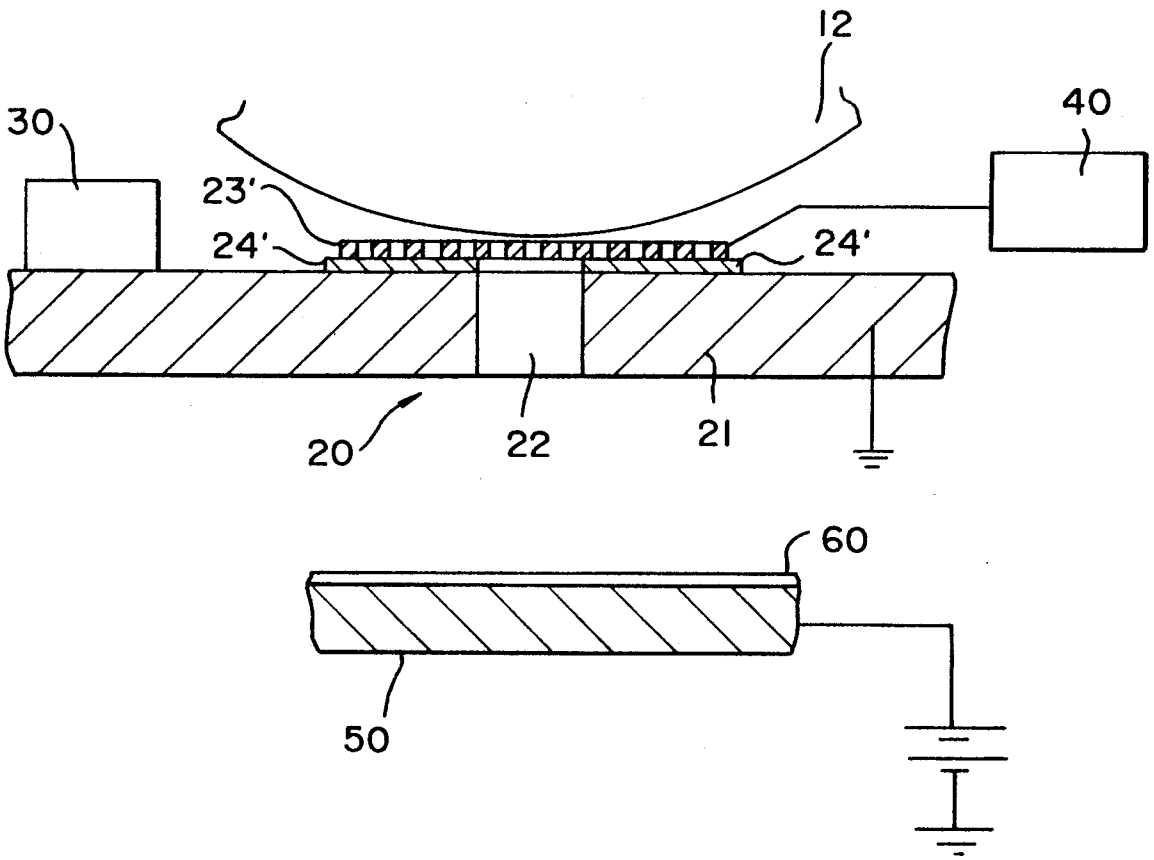
FIG. 7 is a fragmentary sectional view showing a fourth example of the image forming apparatus according to the invention.

The following describes examples of the present invention.

EXAMPLE 1

As shown in FIG. 1, an image forming apparatus of the present invention includes a toner container 10 into which toner is supplied as needed from a toner hopper or the like. The toner container 10 has an opening 11 in the lower part thereof, the opening 11 accommodating the upper part of a toner feed roller 12, which functions as a toner feed means. The toner feed roller 12 is a sponge roller comprising a roller portion 13 and a sponge layer 14 of an elastic insulator disposed on the outer circumferential surface thereof. A toner control member 20 is horizontally located below and in close proximity to the toner feed roller 12. Image signals are supplied to the toner control member 20 from an image information generating unit 40. The image information generating unit 40 operates in accordance with image-information signals sent from a word processor, a facsimile machine, a computer or the like, and generates electric image signals corresponding to the image information. In accordance with the electric image signals, the toner control member 20 controls the application of the powdered toner which has been electrically charged in a prescribed polarity and fed from the toner feed roller 12, onto a recording sheet 60 placed below the toner control member 20, thus forming a prescribed toner image on the recording sheet 60. The toner control member 20 may be so located as to be pressed against the toner feed roller 12.

The toner control member 20 is provided with an ultrasonic vibration generating unit 30 for generating ultrasonic vibration. A base electrode 50 is disposed below the toner control member 20 in such a manner that they face each other.

The recording sheet 60 on which a toner image is to be formed is placed on the base electrode 50. The base electrode 50 may be installed movably in the direction of arrow A together with the recording sheet 60 placed thereon, or may be fixed in position, with the recording sheet 60 thereon being moved by an appropriate paper transport means. After a prescribed toner image has been formed on the recording sheet 60 under the control of the toner control member 20, the recording sheet 60 is transported to a prescribed fixing device (not shown), by which the toner image is fixed to the recording sheet 60.

As shown in FIG. 2, the toner control member 20 onto which negatively charged toner, for example, is fed by means of the toner feed roller 12, comprises a horizontally located conductive plate 21 having a toner passage 22 in the form of a pinhole. An upper conductive electrode 23 in the form of mesh is mounted on the upper surface (the toner-feed side) of the conductive plate 21 to cover the upper opening of the toner passage 22, while a lower electrode 25 also in the form of mesh is mounted on the lower surface (the toner-ejection side) of the conductive plate 21 to cover the lower opening of the toner passage 22, with an insulating member 24 interposed between the lower electrode 25 and the lower surface of the conductive plate 21. The upper mesh electrode 23 is disposed in close proximity to or pressed against the toner feed roller 12. The ultrasonic vibration generating unit 30 is mounted on the conductive plate 21 so that ultrasonic vibration can be applied at least to the upper mesh electrode 23. It is desirable that the ultrasonic vibration generating unit 30 should apply ultrasonic vibration to the upper mesh electrode 23 alone.

The conductive plate 21 is grounded, so that the upper mesh conductive electrode 23 is grounded through the conductive plate 21.

Electric image signals are supplied from the image information generating unit 40 to the lower mesh electrode 25. The image information generating unit 40 generates electric image signals in accordance with the image information, and applies to the lower mesh electrode 25, for example, a voltage of +100 V as an image forming signal to form an image or a voltage of −100 V as a non-image forming signal to form no image. When the voltage of +100 V is applied to the lower mesh electrode 25 as an image forming signal from the image information generating unit 40, an electric field directed from the lower mesh electrode 25 toward the grounded upper mesh electrode 23 is formed within the toner passage 22. On the other hand, when the voltage of −100 V is applied to the lower mesh electrode 25 as a non-image forming signal from the image information generating unit 40, an electric field directed from the upper mesh electrode 23 toward the lower mesh electrode 25 is formed within the toner passage 22.

The operation of the image forming apparatus of the above construction will now be described.

Negatively charged toner in the toner container 10 is fed onto the upper mesh electrode 23 of the toner control member 20 by the rotation of the toner feed roller 12. Since ultrasonic vibration of a predetermined amplitude is being applied to the upper mesh electrode 23 by the ultrasonic vibration generating unit 30, lumps of toner are suitably crushed into particles to pass through the upper mesh electrode 23 into the toner passage 22.

The movement of the toner which has entered the toner passage 22 is controlled in accordance with the electric image signal supplied to the lower mesh electrode 25, the toner being allowed either to fall onto the recording sheet 60 or to return to the upper mesh electrode 23.

For example, when the voltage of +100 V is applied to the lower mesh electrode 25 by the image information generating unit 40, an electric field directed upward from the lower mesh electrode 25 to the upper mesh electrode 23 is formed within the toner passage 22. This electric field causes the negatively charged toner particles to be attracted to the lower mesh electrode 25, pass therethrough, and fall onto the recording sheet 60 placed on the base electrode 50. A positive bias voltage is applied to the base electrode 50 with respect to the upper mesh electrode 23, thereby forming an electric field for directing the toner ejected from the toner passage 22 toward the base electrode 50. This accelerates the falling of the toner toward the base electrode 50. The bias voltage applied to the base electrode 50 is sufficiently greater than that of the electric signal applied to the lower mesh electrode 25. In the case where the toner is negatively charged as in this example, the bias voltage is set within the range of 300 to 1000 V. If the bias voltage is smaller than 300 V, the toner may not fall accurately onto a specified position, thereby deteriorating the quality of the resultant image. On the other hand, if the bias voltage is greater than 1000 V, electrical discharge may arise.

When a non-image forming signal is generated by the image information generating unit 40 and the voltage of −100 V is applied to the lower mesh electrode 25, an electric field directed downward from the upper mesh electrode 23 to the lower mesh electrode 25 is formed within the toner passage 22, causing the negatively charged toner to return to the upper mesh electrode 23.

In this way, a prescribed toner image is formed on the recording sheet 60.

In the above example, the upper mesh electrode 23 is grounded, but alternatively, a voltage having the opposite polarity from that applied to the lower mesh electrode 25 may be applied to the upper mesh electrode 23 in accordance with the signal supplied from the image information generating unit 40.

In the present invention, it is desirable to use toner having a relatively small average particle size of 5 to 20 μm. With the use of such small toner particles, an image having excellent resolution can be obtained.

The thickness of the conductive plate 21 is 0.01 to 1 mm, and the toner passage 22 of the conductive plate 21 is 0.1 to 1 mm in diameter. It is preferable that each aperture of the upper mesh electrode 23 be within the range of 50 to 300 μm, and that each aperture of the lower mesh electrode 25 be made larger than that of the upper mesh electrode 23.

The upper mesh electrode 23 and the lower mesh electrode 25 are usually formed from a Tyler mesh, etching mesh, etc., made of conductive resins or metals such as nickel, stainless steel, aluminum, copper, silver, etc.

The gap between the toner control member 20 and the recording sheet 60 is usually set within the range of 0.3 to 2.5 mm, which may vary according to the magnitude of the voltage applied by the image information generating unit 40.

In this example, a sponge roller is used as the toner feed roller 12. The sponge roller effectively crushes lumps of toner in the toner container 10 while it is rotating, and holds the crushed toner uniformly in the pores on the surface thereof, so that a fixed amount of toner is constantly supplied to the toner control member 20.

A toner feed roller 12' shown in FIG. 3 can also be used which has scrapers 15 formed on the outer circumferential surface thereof. The toner feed roller 12' is made of a rigid resin or a metal such as aluminum, etc.

The rotation speed of the toner feed roller 12 may vary according to the type of roller, the amplitude of the ultrasonic vibration generated by the ultrasonic vibration generating unit 30, or other factors, but the surface speed of 50 mm/second or faster is desirable. If the surface speed of the toner feed roller 12 is slower than 50 mm/second, the resultant toner image cannot attain sufficient density.

The ultrasonic vibration generating unit 30 preferably generates a sine wave, square wave, triangular wave, etc., with the resonant frequency in the range of 20 KHz to 1 MHz. A piezoelectric element such as PZT is used as the ultrasonic vibration generating unit 30.

The ultrasonic wave to be generated by the ultrasonic vibration generating unit 30 is periodically changed in frequency by the modulation of the frequency of the alternating voltage applied thereto. This allows the toner to fall more uniformly from the toner control member 20.

The following describes the reason why the periodical change in the frequency of the ultrasonic wave allows the toner to uniformly fall down from the toner control member 20.

In general, when ultrasonic vibration is applied to the upper mesh electrode 23, standing waves are created therein because interference occurs between waves. The standing waves cause unevenness in the vibration amplitude throughout the upper mesh electrode 23, thereby preventing the toner from uniformly passing through the upper mesh electrode 23. However, when the frequency of the alternating voltage to be applied to the ultrasonic vibration generating unit 30 is modulated so as to change the frequency of the ultrasonic wave to be generated therefrom in a predetermined cycle (i.e., with a predetermined sweep frequency), the ultrasonic vibration nodes created by the standing waves are slowly moved. This prevents the vibration force from being concentrated on any particular point on the upper mesh electrode 23, so that the ultrasonic vibration is uniformly applied throughout the upper mesh electrode 23.

The sweep frequency for changing the frequency of the ultrasonic wave is preferably set at a low level in the range of 10 to 1000 Hz. When the fluctuation of the frequency of the ultrasonic wave is within the range of 1 to 20% of the resonant frequency, unevenness in the distribution of the toner can be effectively prevented. If the sweep frequency is higher than 1000 Hz, the unevenness in the vibration force caused by the standing waves cannot be sufficiently reduced. This makes it difficult to attain uniform distribution of the toner. On the other hand, a sweep frequency lower than 10 Hz would cause variations in the toner distribution per unit time along the transporting direction of the recording sheet, resulting in uneven density of the produced image (causing stripe patterns) unless the recording sheet is transported at a slow speed. Thus, it becomes impossible to form an image at high speed. When the sweep frequency is set within the range of 10 to 1000 Hz, the ultrasonic vibration nodes created by the standing waves slowly move as described above, so that the vibration force is uniformly applied to the upper mesh electrode 23 and the toner particles having the property of gathering about the nodes move with the movement of the nodes. As a result, large lumps of toner on the upper mesh electrode 23 are crushed and spread uniformly thereover, which allows the toner to uniformly fall down from the toner control member 20.

In the above example, the upper mesh electrode 23 onto which the toner is fed is grounded, and the electric image signal is supplied to the lower mesh electrode 25. Alternatively, an insulating member is interposed between the upper mesh electrode 23 and the upper surface of the conductive plate 21, and the lower mesh electrode 25 is grounded and mounted directly on the conductive plate 21, so that the electric image signal is supplied to the upper mesh electrode 23. In this case, a negative voltage is applied as an image forming signal to the upper mesh electrode 23, so that the negatively charged toner fed through the upper mesh electrode 23 passes through the toner passage 22. The toner that has passed through the upper mesh electrode 23 and the toner passage 22 is then allowed to fall toward the base electrode 50 due to the electric field formed as a result of the potential difference between the lower mesh electrode 25 and the base electrode 50. Conversely, when a positive voltage is applied as a non-image forming signal to the upper mesh electrode 23, the negatively charged toner is not allowed to pass through the upper mesh electrode 23. In this manner, a toner image corresponding to the image information is formed on the recording sheet 60.

With use of the apparatus of Example 1, an image was formed and the quality of the image was evaluated. The conditions for the image forming apparatus were as follows:

* Toner feed roller

Sponge roller with a diameter of 15 mm, surface speed; 94 mm/second

* Toner control member

Conductive plate . . . Aluminum plate with a thickness of 0.5 mm

Toner passage . . . Inner diameter; 0.5 mm

Upper mesh electrode . . . 350 Tyler mesh

Lower mesh electrode . . . 150 Tyler mesh

Insulating member . . . Polyethylene sheet with a thickness of 100 μm

* Ultrasonic vibration generating unit

PZT piezoelectric element (Applied voltage: 20 Vrms (sine wave), Applied frequency: 230 KHz±15 KHz, Sweep frequency: 100 Hz)

* Voltage applied to the base electrode: +800 V

* Toner: Non-magnetic toner

* Gap between the lower mesh electrode and the recording sheet: 0.5 mm

In the above image forming apparatus, a sheet of plain paper with no surface treatment and having a thickness of 100 μm was used as a recording sheet, and was transported onto the base electrode 50. The upper mesh electrode 23 of the toner control member 20 was grounded, and voltages of +100 V or −100 V were applied to the lower mesh electrode 25 in accordance with each image signal. The produced image was clear and excellent in resolution, and no fog was noted.

The above test was repeated with the thickness of the recording sheet changed to 70 μm and 150 μm, respectively. As a result, images having exactly the same clearness as that obtained in the above test were obtained.

Furthermore, the same test was repeated with the environmental condition for the image forming apparatus changed as follows:

(1) Temperature; 10° C., Humidity; 30%

(2) Temperature; 20° C., Humidity; 45%

(3) Temperature; 35° C., Humidity; 80%

Under any of the above environmental conditions, the obtained images had the same clearness and the same uniform density as those of the first test.

Furthermore, images were formed with the sweep frequency changed within the range of 10 Hz to 10 KHz. Clear images with uniform density were obtained when the sweep frequency was set at 1000 Hz or lower, but as the frequency was increased beyond 1000 Hz, unevenness in the image density arose in the direction perpendicular to the transporting direction of the recording sheet.

EXAMPLE 2

FIG. 4 shows a second example of the image forming apparatus according to the present invention. In this example, the toner control member 20 is provided with a ring electrode 26 in place of the lower mesh electrode 25 of Example 1. The ring electrode 26 is mounted on the lower surface of the conductive plate 21 and located concentrically with the toner passage 22 so that its interior space 27 communicates with the toner passage 22. An electric image signal is supplied to the ring electrode 26 from the image information generating unit 40 to form an electric field within the toner passage 22. The toner is passed through the mesh electrode 23 disposed on the upper surface of the conductive plate 21, and then is made either to pass through the toner passage 22 or to return to the mesh electrode 23 according to the direction of the electric field formed between the mesh electrode 23 and the ring electrode 26.

Since the ring electrode 26 encircles the lower opening of the toner passage 22, the electric field can be formed in the toner passage 22 with the field strength uniformly distributed in the circumferential direction. This makes it possible to more reliably control the movement of the toner within the toner passage 22.

In this example, the toner passage 22 is 5 to 300 μm in diameter. The ring electrode 26 is made of a metal such as copper, aluminum or the like, the ring diameter being 50 to 500 μm.

In this example also, the upper mesh electrode 23 may be mounted on the conductive plate 21 with an insulating member interposed therebetween so that the electric image signals are supplied to the upper mesh electrode 23. In this case, the ring electrode 26 is grounded.

Using the image forming apparatus of Example 2, images were formed and the quality of the images was evaluated. The image forming apparatus used in this test was the same as the one used for the image quality evaluation test in Example 1, except that a ring electrode having a ring diameter of 0.3 mm was used instead of the lower mesh electrode. The produced images were clear and excellent in resolution, and no fog was noted. Furthermore, changes in the kind of recording sheet or in the environmental conditions caused no variation in the image quality.

EXAMPLE 3

FIG. 5 shows a third example of the image forming apparatus according to the present invention. The toner control member 20 includes an insulating plate 31 provided with a toner passage 32 passing therethrough. On the upper surface of the insulating plate 31 is mounted an upper plate electrode 33 having a hole communicating with the toner passage 32. On the underside of the insulating plate 31 is disposed a lower plate electrode 34 also having a hole communicating with the toner passage 32. The upper plate electrode 33 is grounded, and is pressed against or disposed in close proximity to the toner feed roller 12. Electric image signals are supplied to the lower plate electrode 34 from the image information generating unit 40. The diameter of the toner passage 32 formed in the insulating plate 31 is usually larger than that of the toner particle, and is about 5 to 300 μm. The holes in the upper plate electrode 33 and the lower plate electrode 34 have inner diameters equal to or slightly larger than the inner diameter of the toner passage 32. An ultrasonic vibration generating unit 30 is mounted on the insulating plate 31 so that the ultrasonic vibration generated therefrom is transmitted via the insulating plate 31 to the upper plate electrode 33.

In an image forming apparatus having a toner control member of the above construction, negatively charged toner in the toner container 10 is fed onto the upper plate electrode 33 by the rotation of the toner feed roller 12. The ultrasonic vibration generated by the ultrasonic vibration generating unit 30 is applied to the upper plate electrode 33 via the insulating plate 31, so that lumps of toner fed onto the upper plate electrode 33 are crushed by means of the ultrasonic vibration. The toner passes through the hole of the upper plate electrode 33 and enters the toner passage 32.

A predetermined voltage is applied to the lower plate electrode 34 in accordance with the electric image signal supplied from the image information generating unit 40. When a positive voltage is applied to the lower plate electrode 34 as an image forming signal, an upwardly directed electric field is formed within the toner passage 32 between the lower plate electrode 34 and the grounded upper plate electrode 33, causing the negatively charged toner that has entered the toner passage 32 to pass through the toner passage 32. The toner thus passed through the toner passage 32 falls onto a recording sheet 60 to form a toner image thereon. On the other hand, when a negative voltage is applied to the lower plate electrode 34 as a non-image forming signal from the image information generating unit 40, a downwardly directed electric field is formed within the toner passage 32 between the lower plate electrode 34 and the grounded upper plate electrode 33, causing the negatively charged toner to return from the toner passage 32 to the upper plate electrode 33.

In this example, the upper plate electrode 33 is grounded, but alternatively, a bias voltage having the opposite polarity (+) from that of the toner (−) may be applied to the upper plate electrode 33 to hold the toner thereon, thus preventing the toner from falling off the upper plate electrode 33 by gravity. Also, the electric image signals generated by the image information generating unit 40 may be supplied to the upper plate electrode 33.

In the toner control means of this example, the insulating plate 31 may be provided with numerous toner passages 32*a*, 32*b*, . . . aligned along the longitudinal direction of the toner feed roller 12, as shown in FIG. 6. In this case, a single upper plate electrode 33 is disposed on the upper surface of the insulating plate 31. The upper plate electrode 33 is provided with holes corresponding to the respective upper openings of the toner passages 32*a*, 32*b*, . . . . On the underside of the insulating plate 31 are disposed lower plate electrodes 34*a*, 34*b*, . . . corresponding to the toner passages 32*a*, 32*b*, . . . respectively. With such construction, the toner passing through each toner passage 32 will form a pixel, and an electric image signal corresponding to each pixel is given from the information generating unit 40 to each of the lower plate electrodes 34*a*, 34*b*, . . . . Thus, pixels arranged in a line along the longitudinal direction of the toner feed roller 12 (the direction perpendicular to the transporting direction of the recording sheet) can be formed simultaneously. This enables the image to be formed at high speed. Since the lower plate electrodes 34*a*, 34*b*, . . . are used to form respective electric fields only within the corresponding toner passages 32*a*, 32*b*, . . . and without affecting the adjacent toner passages, an accurate image corresponding to the image information can be formed without causing any fog.

In this example, the upper plate electrode 33 and the lower plate electrodes 34*a*, 34*b*, . . . can be formed by patterning a silver foil, aluminum sheet, or the like, in a desired pattern.

Using the image forming apparatus of this example, images were formed for evaluation of the image quality. For the toner control member 20 of the image forming apparatus, a polyimide sheet with a thickness of 0.1 mm was used as the insulating plate 31, which is provided with the toner passage 32 having an inner diameter of 100 μm. Copper electrodes were used as the upper and lower plate electrodes. The other arrangements of the image forming apparatus used in this test are the same as those of the one used for the image quality evaluation test in Example 1. The produced images were clear and excellent in resolution, and no fog was noted. Furthermore, changes in the kind of recording paper or in the environmental conditions caused no variation in the image quality.

EXAMPLE 4

FIG. 7 shows a fourth example of the image forming apparatus according to the present invention. The toner control member 20 includes a conductive plate 21 through which a toner passage 22 is formed. On the upper surface of the conductive plate 21, an insulating member 24' having a hole with an inner diameter equal to that of the toner passage 22 is mounted concentrically with the toner passage 22. On the insulating member 24' is mounted a mesh electrode 23' to cover the upper opening of the toner passage 22. An electric image signal is supplied to the mesh electrode 23' from the image information generating unit 40. The conductive plate 21 is grounded. The ultrasonic vibration generating unit 30 applies ultrasonic vibration to the conductive plate 21. The base electrode 50 is disposed below the conductive plate 21 and appropriately spaced apart therefrom.

Negatively charged toner fed onto the mesh electrode 23' is subjected to ultrasonic vibration so that lumps of toner particles are suitably crushed into particles to pass through the mesh electrode 23'. When a prescribed negative voltage is applied to the mesh electrode 23' as an image forming signal, the negatively charged toner is made to pass through the toner passage 22. Thereafter, the falling of the toner is accelerated by the electric field formed between the conductive plate 21 and the base electrode 50, allowing the toner to fall onto a predetermined position on the recording sheet 60 placed on the base electrode 50.

EXAMPLE 5

Figure 8:
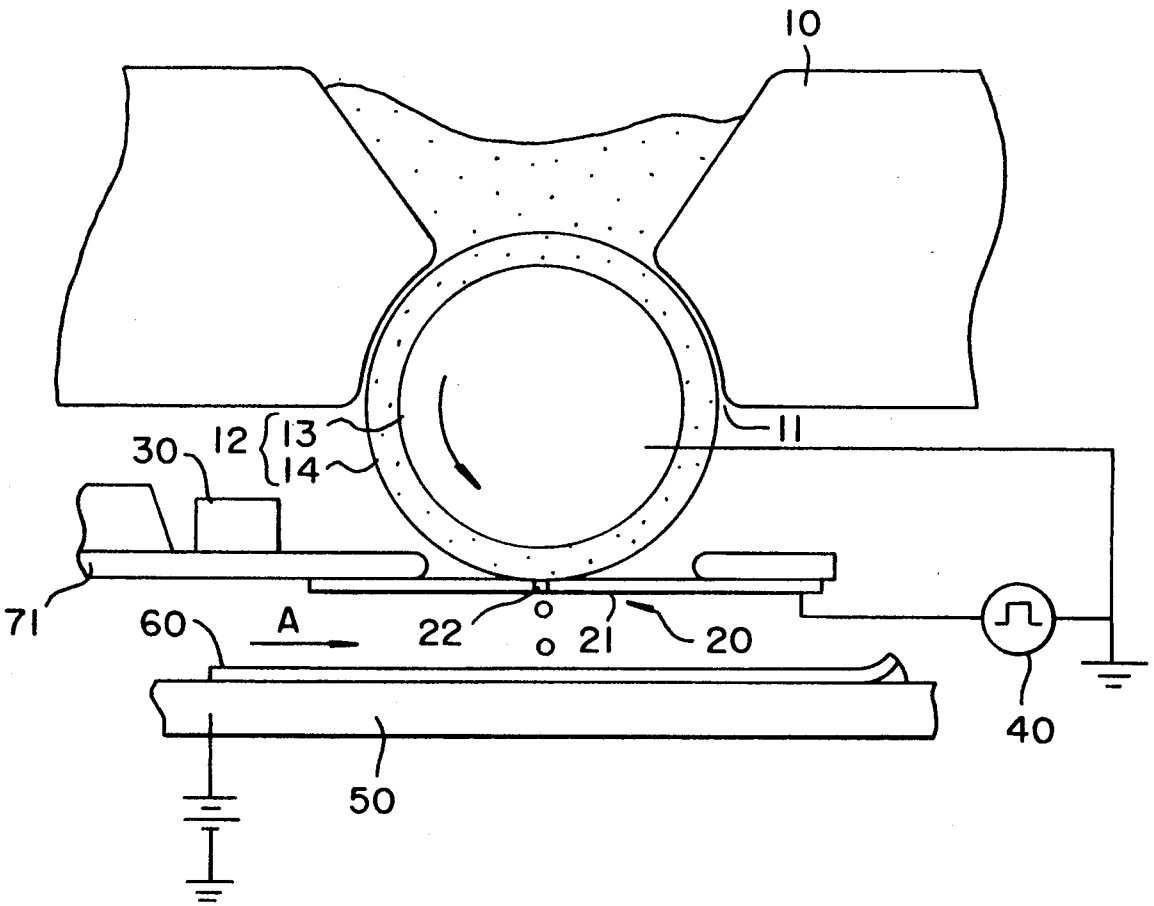
FIG. 8 is a fragmentary sectional view showing a fifth example of the image forming apparatus according to the invention.

FIG. 8 shows a fifth example of the image forming apparatus according to the present invention. In this example, the toner feed roller 12 is a sponge roller comprising a conductive metal roller portion 13 and a sponge layer 14 of an elastic insulator disposed on the outer circumferential surface thereof. The negatively charged toner in the toner container 10 is suitably stirred while the toner feed roller 12 is rotating, and is held almost evenly in the pores of the sponge layer 14. The roller portion 13 of the toner feed roller 12 is grounded.

Below the toner feed roller 12 is disposed a toner control member 20 which includes a conductive plate 21 disposed in a substantially horizontal position. The conductive plate 21 is pressed against the sponge layer 14 of the toner feed roller 12, and is supported on a horizontally located ultrasonic vibration transmitting plate 71. The ultrasonic vibration transmitting plate 71 is provided with the ultrasonic vibration generating unit 30 so that the ultrasonic vibration generated by the ultrasonic vibration generating unit 30 is transmitted via the ultrasonic vibration transmitting plate 71 to the conductive plate 21.

A toner passage 22 is formed in the portion of the conductive plate 21 against which the sponge layer 14 of the toner feed roller 12 is pressed. The image information generating unit 40 is connected to the conductive plate 21. The image information generating unit 40 applies to the conductive plate 21 a voltage of +100 V when an image is to be formed and a voltage of −100 V when an image is not to be formed.

The base electrode 50 is disposed in a substantially horizontal manner below the toner control member 20. The recording sheet 60 is placed on the base electrode 50.

In an image forming apparatus of the above construction, the negatively charged toner carried on the sponge layer 14 of the toner feed roller 12 is fed onto the conductive plate 21 of the toner control member 20. Since ultrasonic vibration is applied to the conductive plate 21, lumps of toner fed thereto are suitably separated into particles.

A prescribed voltage is applied to the conductive plate 21 in accordance with an electric image signal supplied from the image information generating unit 40. When an image forming signal is issued from the image information generating unit 40 to apply a positive voltage to the conductive plate 21, the negatively charged toner on the conductive plate 21 is moved away from the toner feed roller 12. This causes the toner to pass through the toner passage 22. The toner thus passed through the toner passage 22 is attracted toward the base electrode 50 to which a positive voltage is applied, and is made to adhere to the recording sheet 60 placed on the base electrode 50.

Conversely, when a negative voltage is applied to the conductive plate 21 by the image information generating unit 40 as a non-image forming signal, the negatively charged toner on the conductive plate 21 is repelled therefrom to move back toward the toner feed roller 12. Thus, there is no possibility of the toner on the conductive plate 21 passing through the toner passage 22.

A test was conducted to evaluate the quality of images formed by the image forming apparatus of this example. The toner feed roller 12 used in the image forming apparatus had an aluminum roller portion 13 of 15 mm in diameter (surface speed: 94 mm/second) with a sponge layer of 1.5 mm in thickness on the circumferential surface thereof. The conductive plate 21 of the toner control member 20 was made of an aluminum plate of 0.5 mm in thickness with a toner passage having an inner diameter of 0.5 mm. Other conditions were the same as those for the image forming apparatus used for the image quality evaluation test in Example 1. The produced images were clear and excellent in resolution, and no fog was noted. Also, changes in the kind of recording paper or in the environmental conditions caused no variation in the image quality.

Since the entire plate of the toner control member functions as an electrode, the image forming apparatus of this example does not require separate electrodes on the plate, thereby greatly facilitating the production of the image forming apparatus.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An image forming apparatus comprising:

a toner feed means for feeding powder toner electrically charged in a prescribed polarity;

a toner control means, located in close proximity to said toner feed means, including a plate provided with a toner passage through which the powder toner fed from said toner feed means can pass, and including an electrode for forming an electric field within said toner passage, said electric field directing said powder toner through said toner passage from a toner-feed side to a toner-ejection side of said plate;

an ultrasonic vibration generating means, provided on said plate, for applying ultrasonic vibration to said plate;

an image information generating means, connected to said toner control means, for applying a predetermined voltage to said electrode of said toner control means in accordance with image information, therein allowing said electrode to form said electric field; and a base electrode located at the toner-ejection side of said toner control means and appropriately spaced apart from the toner control means, to which base electrode a predetermined voltage is applied to form an electric field for directing said powder toner from said toner passage toward said base electrode.

2. An apparatus according to claim 1, wherein said ultrasonic vibration generating means produces ultrasonic waves, a frequency of which can be changed.

3. An apparatus according to claim 1, wherein said electrode comprises a pair of mesh electrodes insulated from each other and mounted on either side of said plate so as to cover each opening of said toner passage.

4. An apparatus according to claim 1, wherein said electrode comprises a mesh electrode mounted on the toner-feed side of said plate to cover one of the openings of said toner passage, and also comprises a ring electrode disposed on the toner-ejection side of said plate, an interior space of said ring electrode communicating with the other opening of said toner passage, and said ring electrode and said mesh electrode being insulated from each other.

5. An apparatus according to claim 1, wherein said electrode comprises a pair of plate electrodes insulated from each other and mounted on either side of said plate, each of said plate electrodes having a hole passing therethrough and communicating with each opening of said toner passage.

6. An apparatus according to claim 1, wherein said toner feed means is a sponge roller having sponge on a circumference thereof.

7. An image forming apparatus comprising:

a toner feed means for feeding powder toner electrically charged in a prescribed polarity;

a toner control means, located in close proximity to said toner feed means, including a conductive plate provided with a toner passage through which the powder toner fed from said toner feed means can pass, and an electrode mounted on said conductive plate, said electrode and said conductive plate being capable of forming an electric field within said toner passage, said electric field directing said powder toner through said toner passage from a toner-feed side to a toner-ejection side of said conductive plate;

an ultrasonic vibration generating means, provided on said conductive plate, for applying ultrasonic vibration to said conductive plate;

an image information generating means, connected to said toner control means, for producing a potential difference between said conductive plate and said electrode of said toner control means in accordance with image information, therein allowing said conductive plate and said electrode to form said electric field; and a base electrode which is located at the toner-ejection side of said toner control means and appropriately spaced apart from said toner-ejection side, and to which a predetermined voltage is applied to form an electric field for directing said powder toner from said toner passage toward said base electrode.

8. An apparatus according to claim 7, wherein said electrode is in a form of mesh and mounted on the toner-feed side of said conductive plate to cover one of the openings of said toner passage, said electrode being insulated from said conductive plate.

9. An apparatus according to claim 7, wherein said ultrasonic vibration generating means produces ultrasonic waves, a frequency of which can be changed.

10. An image forming apparatus comprising:

a toner control means including a conductive plate provided with a toner passage through which powder toner can pass, said powder toner being electrically charged in a prescribed polarity;

a toner feed means for feeding said powder toner onto said conductive plate of said toner control means, said toner feed means including a conductive portion;

an ultrasonic vibration generating means, provided on said conductive plate, for applying ultrasonic vibration to said conductive plate;

an image information generating means, connected to said toner control means, for producing a potential difference between said conductive portion of said toner feed means and said conductive plate in accordance with image information, therein forming an electric field within said toner passage, said electric field directing said powder toner through said toner passage from a toner-feed side to a toner-ejection side of said conductive plate; and a base electrode which is located at the toner-ejection side of said toner control means and appropriately spaced apart therefrom, and to which a predetermined voltage is applied so as to form an electric field for directing said powder toner from said toner passage toward said base electrode.

11. An apparatus according to claim 10, wherein said toner feed means is a sponge roller comprising a conductive roller portion and an insulating sponge portion disposed on a circumferential surface thereof.

12. An apparatus according to claim 10, wherein said ultrasonic vibration generating means produces ultrasonic waves, a frequency of which can be changed.

13. An image forming apparatus comprising:

a toner feed means for feeding powder toner electrically charged in a prescribed polarity;

a toner control means, located in close proximity to said toner feed means, including a plate provided with a toner passage through which the powder toner fed from said toner feed means can pass, and including an electrode for forming an electric field within said toner passage, said electric field directing said powder toner through said toner passage from a toner-feed side to a toner-ejection side of said plate;

an ultrasonic vibration generating means, provided on said plate for applying ultrasonic vibration to said plate, said ultrasonic vibration generating means being capable of changing a frequency of ultrasonic waves;

an image information generating means, connected to said toner control means, for applying a predetermined voltage to said electrode of said toner control means in accordance with image information, therein allowing said electrode to form said electric field; and a base electrode located at the toner-ejection side of said toner control means and appropriately spaced apart therefrom, to which base electrode a predetermined voltage is applied to form an electric field for directing said powder toner from said toner passage toward said base electrode.

14. An image forming apparatus according to claim 13, wherein the frequency of ultrasonic waves are changed with a predetermined sweep frequency.

* * * * *